US005891610A

United States Patent [19]

Bauer et al.

[11] Patent Number: 5,891,610

[45] Date of Patent: Apr. 6, 1999

[54] THERMALLY PROCESSABLE IMAGING ELEMENT WITH IMPROVED ADHESION OF THE OVERCOAT LAYER

[75] Inventors: Charles L. Bauer, Webster; Wayne A. Bowman, Walworth, both of N.Y.

[73] Assignee: Eastman Kodak Company, Rochester, N.Y.

[21] Appl. No.: 873,953

[22] Filed: Jun. 12, 1997

Related U.S. Application Data

[63] Continuation-in-part of Ser. No. 756,100, Nov. 22, 1996, abandoned.

[51] Int. Cl.[6] ..... G03C 1/76; G03C 1/498

[52] U.S. Cl. ..... 430/523; 430/531; 430/617; 430/619

[58] Field of Search ..... 430/523, 531, 430/617, 619

[56] References Cited

U.S. PATENT DOCUMENTS

| | | | |
|---|---|---|---|
| 3,080,254 | 3/1963 | Grant | 117/36.8 |
| 3,457,075 | 7/1969 | Morgan et al. | 96/67 |
| 3,933,508 | 1/1976 | Ohkube et al. | 96/114.1 |
| 4,164,602 | 8/1979 | Fabel | 428/334 |
| 4,741,992 | 5/1988 | Przezdziecki | 430/523 |
| 4,828,971 | 5/1989 | Przezdziecki | 430/531 |
| 4,886,739 | 12/1989 | Przezdziecki | 430/617 |
| 4,942,115 | 7/1990 | Przezdziecki | 430/523 |
| 5,015,566 | 5/1991 | Dappen et al. | 430/567 |
| 5,294,526 | 3/1994 | Przezdziecki et al. | 430/536 |
| 5,310,640 | 5/1994 | Markin et al. | 430/527 |
| 5,393,649 | 2/1995 | Bauer et al. | 430/523 |
| 5,418,120 | 5/1995 | Bauer et al. | 430/527 |
| 5,422,234 | 6/1995 | Bauer et al. | 430/527 |

FOREIGN PATENT DOCUMENTS 2054186 11/1982 United Kingdom .

OTHER PUBLICATIONS

*Research Disclosure,* Dec. 1978, Item No. 17643.

*Research Disclosure,* Jun. 1978, Item No. 17029.

*Primary Examiner*—Thorl Chea

*Attorney, Agent, or Firm*—Edith A. Rice

[57] ABSTRACT

Thermally processable imaging elements in which the image is formed by imagewise heating or by imagewise exposure to light followed by uniform heating has a protective overcoat layer containing poly(silicic acid), and a mixture of a water-soluble hydroxyl-containing polymer and a polyvinyl acetal.

10 Claims, No Drawings

THERMALLY PROCESSABLE IMAGING ELEMENT WITH IMPROVED ADHESION OF THE OVERCOAT LAYER

CROSS-REFERENCE TO RELATED APPLICATION

This is a continuation-in-part of application Ser. No. 08/756,100 filed Nov. 22, 1996, now abandoned, entitled Thermally Processable Imaging Element with Improved Adhesion of the Overcoat Layer, the entire disclosure of which is incorporated herein by reference.

FIELD OF THE INVENTION

This invention relates in general to imaging elements and in particular to thermally processable imaging elements. More specifically, this invention relates to thermally processable imaging elements with improved adhesion between the overcoat layer and the imaging layer.

BACKGROUND OF THE INVENTION

Thermally processable imaging elements, including films and papers, for producing images by thermal processing are well known. These elements include photothermographic elements in which an image is formed by imagewise exposure of the element to light followed by development by uniformly heating the element. These elements also include thermographic elements in which an image is formed by imagewise heating the element. Such elements are described in, for example, *Research Disclosure*, June 1978, Item No. 17029 and U.S. Pat. Nos. 3,080,254, 3,457,075 and 3,933, 508.

An important feature of the aforesaid thermally processable imaging elements is a protective overcoat layer. To be fully acceptable, a protective overcoat layer for such imaging elements should: (a) provide resistance to deformation of the layers of the element during thermal processing, (b) prevent or reduce loss of volatile components in the element during thermal processing, (c) reduce or prevent transfer of essential imaging components from one or more of the layers of the element into the overcoat layer during manufacture of the element or during storage of the element prior to imaging and thermal processing, (d) enable satisfactory adhesion of the overcoat to a contiguous layer of the element, and (e) be free from cracking and undesired marking, such as abrasion marking, during manufacture, storage, and processing of the element.

A particularly preferred overcoat for thermally processable imaging elements is an overcoat comprising poly(silicic acid) as described in U.S. Pat. No. 4,741,992, issued May 3, 1988. Advantageously, water-soluble hydroxyl-containing monomers or polymers are incorporated in the overcoat layer together with the poly(silicic acid).

One of the most difficult problems involved in the manufacture of thermally processable imaging elements is that the protective overcoat layer typically does not exhibit adequate adhesion to the imaging layer. The problem of achieving adequate adhesion is particularly aggravated by the fact that the imaging layer is typically hydrophobic while the overcoat layer is typically hydrophilic. One solution to this problem is that described in U.S. Pat. No. 4,886,739, issued Dec. 12, 1989, in which a polyalkoxysilane is added to the thermographic or photothermographic imaging composition and is hydrolyzed in situ to form an $Si(OH)_4$ moiety which has the ability to crosslink with binders present in the imaging layer and the overcoat layer. Another solution to the problem is that described in U.S. Pat. No. 4,942,115, issued Jul. 17, 1990, in which an adhesion-promoting layer composed of certain adhesion-promoting terpolymers is interposed between the imaging layer and the overcoat layer. U.S. Pat. Nos. 5,393,649, 5,418,120, and 422,234 also disclose the use of adhesion-promoting interlayers which contain (i) a polymer having pyrrolidone functionally ('649), (ii) a polyalkoxysilane ('120) or (iii) a polymer having epoxy functionality ('234).

The known solutions to the problem of providing adequate overcoat adhesion with thermally processable elements exhibit certain disadvantages which have hindered their commercial utilization. For example, while incorporation of a polyalkoxysilane in the imaging composition brings about a gradual increase in adhesion on aging of the element, the in situ hydrolysis of the polyalkoxysilane is slow and its rate is limited by the availability of water in the coated layer. Moreover, the alcohol which is formed as a by-product of the hydrolysis, for example, the ethyl alcohol that is formed by hydrolysis of tetraethoxysilane, is unable to escape through the highly impermeable overcoat layer and tends to migrate into the support. The support is typically a polyester, most usually poly(ethylene terephthalate), and migration of the alcohol into such a support causes a highly undesirable width-wise curl which makes the imaging element very difficult to handle. A serious consequence of such width-wise curl, even though it may be very slight in extent, is jamming of processing equipment.

The problem of unwanted curl can be reduced by use of the adhesion-promoting interlayer of U.S. Pat. No. 4,942, 115, but use of this interlayer can result in adverse sensitometric effects, requires an additional coating step which makes it economically less attractive, and requires the use of terpolymers which are costly, difficult to handle and environmentally disadvantageous.

In general, the use of an adhesion-promoting interlayer between the imaging layer and the overcoat layer makes manufacture of the thermally processable imaging element more complex which adds to the cost of manufacture of the imaging element.

PROBLEM TO BE SOLVED BY THIS INVENTION

It is toward the objective of providing an improved thermally processable imaging element having an overcoat layer with improved adhesion to the underlying layers which overcomes the disadvantages of the prior art that the present invention is directed.

SUMMARY OF THE INVENTION

In accordance with this invention, a thermally processable imaging element comprises a support, a thermographic or photothermographic imaging layer, and an overcoat layer comprising:

(A) 50 to 90% by weight of poly(silicic acid) represented by formula (I):

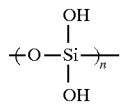

(I)

wherein n is an integer within the range of at least 3 to about 600; and (B) 10 to 50% by weight of a mixture of:

(i) a water-soluble hydroxyl-containing polymer; and (ii) a water-soluble polyvinyl acetal represented by Formula (II):

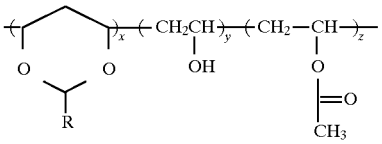

(II)

wherein

R is hydrogen or a substituted or unsubstituted alkyl group of 1 to 8 carbon atoms, such as methyl, ethyl, propyl, butyl or hexyl, or a substituted or unsubstituted cycloalkyl group of 5 to 8 carbon atoms, such as cyclohexyl or substituted or unsubstituted aryl group such as phenyl;

x represents 2 to 30 mole percent;

y represents 50 to 98 mole percent; and z represents 0 to 10 mole percent.

ADVANTAGEOUS EFFECT OF THE INVENTION

The use of a polyvinyl acetal in the overcoat which overcomes the difficult problem of providing good adhesion between an overcoat which is typically hydrophilic and an imaging layer which is typically hydrophobic. Moreover, use of a polyvinyl acetal in the overcoat not only provides very effective adhesion but causes no adverse sensitometric effects and involves the use of low cost, readily available materials which are easily handled and coated and are environmentally advantageous. The overcoat layer utilized in the thermally processable imaging elements of this invention performs several important functions as hereinabove described.

DESCRIPTION OF THE PREFERRED EMBODIMENTS

In accordance with this invention, a thermally processable imaging element has an overcoat with improved adhesion to the imaging layer of the element.

The overcoat layer is generally transparent and colorless. If the overcoat is not transparent and colorless, then it is necessary, if the element is a photothermographic element, that it be at least transparent to the wavelength of radiation employed to provide and view the image. The overcoat does not significantly adversely affect the imaging properties of the element, such as the sensitometric properties in the case of a photothermographic element, such as minimum density, maximum density, or photographic speed.

The overcoat composition preferably comprises 50 to 90% by weight of poly(silicic acid) represented by formula (I):

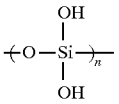

(I)

wherein n is an integer within the range of at least 3 to about 600.

The overcoat also comprises 10 to 50% by weight of a mixture of (i) a water-soluble hydroxyl-containing polymer that is compatible with the poly(silicic acid) and (ii) a water-soluble polyvinyl acetal representing formula (II):

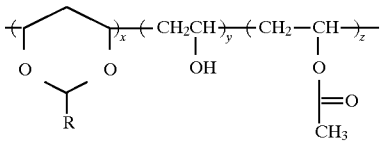

(II)

wherein R, x, y, and z are as defined above.

When reference in this application is made to a substituted or unsubstituted group it is to be understood that the nature of the substituents is not critical and any substituent that does not destroy properties necessary for a thermally processable imaging element can be used. It is also to be understood that any substituent may itself be substituted. Examples of substituents include: halogen, for example, chloro, fluoro, bromo, iodo; hydroxyl, alkoxy, particularly "lower alkoxy" (that is, with 1 to 6 carbon atoms, for example, methoxy, ethoxy); substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl, chlorophenyl, etc.); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as sulfo alkyl, carboxyalkyl and the like; and others known in the art. With regard to any alkyl group or alkylene group, it will be understood that these can be branched or unbranched and include ring structures.

Unless otherwise specified % by weight is based on the weight of the dried overcoat layer.

Examples of water-soluble hydroxyl-containing polymers are acrylamide polymers, water-soluble cellulose derivatives, hydroxy ethyl cellulose, water-soluble cellulose acetate, and poly(vinyl alcohol). Partially hydrolyzed poly (vinyl alcohols) are preferred. Overcoat compositions comprising poly(silicic acid) and a water-soluble hydroxyl-containing polymer or monomer are described in, for example, U.S. Pat. No. 4,741,992, the entire disclosures of which are incorporated herein by reference.

Preferred polyvinyl acetals include polymers of formula (II) wherein R is $CH_3$, x is 10 and y is 90; or R is $CH_3$, x is 20 and y is 80.

The thermally processable imaging element of this invention can be a black-and-white imaging element or a dye-forming imaging element. It can be of widely varying construction as long as it includes a support, an imaging layer and an overcoat layer, as described herein.

The thermally processable element can comprise a variety of supports. Examples of useful supports are poly (vinylacetal) film, polystyrene film, poly (ethyleneterephthalate) film, polycarbonate film, and related films and resinous materials, as well as paper, glass, metal, and other supports that withstand the thermal processing temperatures.

Typical photothermographic elements within the scope of this invention comprise at least one imaging layer containing in reactive association in a binder, preferably a binder comprising hydroxyl groups, (a) photographic silver halide prepared in situ and/or ex situ, (b) an image-forming combination comprising (i) an organic silver salt oxidizing agent, preferably a silver salt of a long chain fatty acid, such as silver behenate, with (ii) a reducing agent for the organic silver salt oxidizing agent, preferably a phenolic reducing agent, and (c) an optional toning agent. References describing such imaging elements include, for example, U.S. Pat. Nos. 3,457,075; 4,459,350; 4,264,725 and 4,741,992 and *Research Disclosure*, June 1978, Item No. 17029.

In order to improve image tone, improve printout, provide better visual contrast and enhance the appearance of the thermally processable imaging elements of this invention, a small amount of a colorant can be added to the overcoat layer. Blue colorants, such as Victoria Pure Blue BO, Victoria Brilliant Blue G, Serva Blue WS, Aniline Blue, Page Blue G-90 and Methylene Blue, are especially useful for this purpose.

The photothermographic element comprises a photosensitive component that consists essentially of photographic silver halide. In the photothermographic material it is believed that the latent image silver from the silver halide acts as a catalyst for the described image-forming combination upon processing. A preferred concentration of photographic silver halide is within the range of 0.01 to 10 moles of photographic silver halide per mole of silver behenate in the photothermographic material. Other photosensitive silver salts are useful in combination with the photographic silver halide if desired. Preferred photographic silver halides are silver chloride, silver bromide, silver bromochloride, silver bromoiodide, silver chlorobromoiodide, and mixtures of these silver halides. Very fine grain photographic silver halide is especially useful. The photographic silver halide can be prepared by any of the known procedures in the photographic arL Such procedures for forming photographic silver halides and forms of photographic silver halides are described in, for example, *Research Disclosure*, December 1978, Item No. 17029 and *Research Disclosure*, June 1978, Item No. 17643. Tabular grain photosensitive silver halide is also useful, as described in, for example, U.S. Pat. No. 4,435,499. The photographic silver halide can be unwashed or washed, chemically sensitized, protected against the formation of fog, and stabilized against the loss of sensitivity during keeping as described in the above Research Disclosure publications. The silver halides can be prepared in situ as described in, for example, U.S. Pat. No. 4,457,075, or prepared ex situ by methods known in the photographic art.

The photothermographic element typically comprises an oxidation-reduction image forming combination that contains an organic silver salt oxidizing agent, preferably a silver salt of a long chain fatty acid. Such organic silver salts are resistant to darkening upon illumination. Preferred organic silver salt oxidizing agents are silver salts of long chain fatty acids containing 10 to 30 carbon atoms. Examples of useful organic silver salt oxidizing agents are silver behenate, silver stearate, silver oleate, silver laurate, silver hydroxystearate, silver caprate, silver myristate, and silver palmitate. Combinations of organic silver salt oxidizing agents are also useful. Examples of useful organic silver salt oxidizing agents that are not organic silver salts of fatty acids are silver benzoate and silver benzotriazole.

The optimum concentration of organic silver salt oxidizing agent in the photothermographic element will vary depending upon the desired image, particular organic silver salt oxidizing agent, particular reducing agent and particular photothermographic element. A preferred concentration of organic silver salt oxidizing agent is within the range of 0.1 to 100 moles of organic silver salt oxidizing agent per mole of silver in the element. When combinations of organic silver salt oxidizing agents are present, the total concentration of organic silver salt oxidizing agents is preferably within the described concentration range.

A variety of reducing agents are useful in the photothermographic element. Examples of useful reducing agents in the image-forming combination include substituted phenols and naphthols, such as bis-beta-naphthols; polyhydroxybenzenes, such as hydroquinones, pyrogailols and catechols; aminophenols, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-4-hydroxymethyl-1-phenyl-3-pyrazolidone; and sulfonamidophenols and other organic reducing agents known to be useful in photothermographic elements, such as described in U.S. Pat. No. 3,933,508, U.S. Pat. No. 3,801,321 and *Research Disclosure*, June 1978, Item No. 17029. Combinations of organic reducing agents are also useful in the photothermographic element.

Preferred organic reducing agents in the photothermographic element are sulfonamidophenol reducing agents, such as described in U.S. Pat. No. 3,801,381. Examples of useful sulfonamidophenol reducing agents are 2,6-dichloro-4-benzene-sulfonamidophenol; benzenesulfonamidophenol; and 2,6-dibromo-4-benzenesulfonamidophenol, and combinations thereof.

An optimum concentration of organic reducing agent in the photothermographic element varies depending upon such factors as the particular photothermographic element, desired image, processing conditions, the particular organic silver salt oxidizing agent, and the particular polyalkoxysilane.

The photothermographic element preferably comprises a toning agent, also known as an activator-toner or toner-accelerator. Combinations of toning agents are also useful in the photothermographic element. Examples of useful toning agents and toning agent combinations are described in, for example, *Research Disclosure*, June 1978, Item No. 17029 and U.S. Pat. No. 4,123,282. Examples of useful toning agents include, for example, phthalimide, N-hydroxyphthalimide, N-potassium-phthalimide, succinimide, N-hydroxy-1,8-naphthalimide, phthalazine, 1-(2H)-phthalazinone and 2-acetylphthalazinone.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

Photothermographic elements and thermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029.

The thermally processable imaging elements of the invention can be prepared by coating the layers on a support by coating procedures known in the photographic art, including dip coating, air knife coating, curtain coating or extrusion coating using hoppers. If desired, two or more layers are coated simultaneously.

Spectral sensitizing dyes are useful in the photothermographic element to confer added sensitivity to the element. Useful sensitizing dyes are described in, for example,

*Research Disclosure*, June 1978, Item No. 17029 and *Research Disclosure*, December 1978, Item No. 17643.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonyiacetamides, such as 2-bromo-2-p-tolysulfonylacetamide; 2-(tribromomethyl sulfonyl)benzothiazole; and 6-substituted-2,4-bis (tribromomethyl)-s-triazines, such as 6-methyl or 6-phenyl-2,4-bis(tribromomethyl)-s-triazine.

The thermally processable elements are exposed by means of various forms of energy. In the case of the photothermographic element such forms of energy include those to which the photographic silver halides are sensitive and include ultraviolet, visible and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

After imagewise exposure of the photothermographic element, the resulting latent image is developed merely by overall heating the element to thermal processing temperature. This overall heating merely involves heating the photothermographic element to a temperature within the range of about 90° C. to 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 130° C.

In the case of a thermographic element, the thermal energy source and means for imaging can be any imagewise thermal exposure source and means that are known in the thermographic imaging art. The thermographic imaging means can be, for example, an infrared heating means, laser, microwave heating means or the like.

Heating means known in the photothermographic and thermographic imaging arts are useful for providing the desired processing temperature for the exposed photothermographic element. The heating means is, for example, a simple hot plate, iron, roller, heated drum, microwave heating means, heated air or the like.

Thermal processing is preferably carried out under ambient conditions of pressure and humidity. Conditions outside of normal atmospheric pressure and humidity are useful.

The components of the thermally processable element can be in any location in the element that provides the desired image. If desired, one or more of the components can be in more than one layer of the element. For example, in some cases, it is desirable to include certain percentages of the reducing agent, toner, stabilizer and/or other addenda in the overcoat layer over the photothermographic imaging layer of the element. This, in some cases, reduces migration of certain addenda in the layers of the element.

It is necessary that the components of the imaging combination be "in association" with each other in order to produce the desired image. The term "in association" herein means that in the photothermographic element the photographic silver halide and the image forming combination are in a location with respect to each other that enables the desired processing and forms a useful image.

The thermally processable imaging element of this invention preferably includes a backing layer. The backing layer utilized in this invention is an outermost layer and is located on the side of the support opposite to the imaging layer. It is typically comprised of a binder and a matting agent which is dispersed in the binder in an amount sufficient to provide the desired surface roughness.

A wide variety of materials can be used to prepare a backing layer that is compatible with the requirements of thermally processable imaging elements. The backing layer should be transparent and colorless and should not adversely affect sensitometric characteristics of the photothermographic element such as minimum density, maximum density and photographic speed. Useful backing layers include those comprised of poly(sihcic acid) and a water-soluble hydroxyl-containing monomer or polymer that is compatible with poly(silicic acid) as described in U.S. Pat. Nos. 4,828,971, 5,310,640 and 5,547,821, the entire disclosures of which are incorporated herein by reference.

The backing layer preferably has a glass transition temperature (Tg) of greater than 50° C., more preferably greater than 100° C., and a surface roughness such that the Roughness Average (Ra) value is greater than 0.8, more preferably greater than 1.2, and most preferably greater than 1.5. As described in U.S. Pat. No. 4,828,971, the Roughness Average (Ra) is the arithmetic average of all departures of the roughness profile from the mean line.

The imaging element can also contain an electroconductive layer which, in accordance with U.S. Pat. No. 5,310,640, is an inner layer that can be located on either side of said support. The electroconductive layer preferably has an internal resistivity of less than $5\times10^{10}$ ohms/square.

In the thermally processable imaging elements of this invention, either organic or inorganic matting agents can be used. Examples of organic matting agents are particles, often in the form of beads, of polymers such as polymeric esters of acrylic and methacrylic acid, e.g., poly (methylmethacrylate), styrene polymers and copolymers, and the like. Examples of inorganic matting agents are particles of glass, silicon dioxide, titanium dioxide, magnesium oxide, aluminum oxide, barium sulfate, calcium carbonate, and the like. Matting agents and the way they are used are further described in U.S. Pat. Nos. 3,411,907 and 3,754,924.

The concentration of matting agent required to give the desired roughness depends on the mean diameter of the particles and the amount of binder. Preferred particles are those with a mean diameter of from about 1 to about 15 micrometers, preferably from 2 to 8 micrometers. The matte particles can be usefully employed at a concentration of about 1 to about 100 milligrams per square meter.

The invention is further illustrated by the following examples.

EXAMPLE 1

A thermally processable imaging element was prepared by coating a poly(ethylene terephthalate) film support, having a thickness of 0.114 mm, with a photothermographic imaging layer and a protective overcoat. The layers of the thermally processable imaging element are coated on a support by coating procedures known in the photographic art, including dip coating, air knife coating, curtain coating or extrusion coating using hoppers. The photothermographic imaging composition was coated from a solvent mixture containing 85 part by weight methyl isobutyl ketone and 15 parts by weight acetone to form an imaging layer of the following dry composition:

TABLE 1

| Component | Dry Coverage ($g/m^2$) |
|---|---|
| Silver behenate | 1.072 |
| AgBr | 0.193 |
| Succinimide | 0.250 |
| *surfactant | 0.006 |
| 2-bromo-2-p-tolylsulfonyl acetamide | 0.070 |
| 2,4-bis(trichloromethyl)-6-(1(maphtho)-S-triazine | 0.017 |
| Sensitizing dye | 0.006 |
| 4-benzenesulfonamidophenol | 1.129 |
| **Binder | 4.678 |

*a polysiloxane fluid available under the trademark SF-96 from General Electric Company
**a poly(vinylbutyral) available under the trademark Butvar To prepare the protective overcoat layer, first a polysilicic acid solution was prepared by mixing 29.4 weight percent water, 1.2% 1N p-toluene sulfonic acid, 34% methanol and 35.4% tetraethoxysilane to form a 16.3 wt % polysilicic acid solution. The polysilicic acid was mixed with polyvinyl alcohol, PVA (Elvanol 52-22 from DuPont, 86–89% hydrolyzed) and a water-soluble polyvinyl acetal (PV Acetal) in water, coated on the imaging layer to give the following composition:

TABLE 2

| Component | Dry Coverage ($g/m^2$) |
|---|---|
| Polysilicic acid | 1.650 |
| Polyvinyl alcohol/polyvinyl acetal | 1.100 |
| Surfactant* | 0.0308 |

*a p-isononylphenoxy polyglycidol surfactant available under the trademark Surfactant 10G from Olin Corporation.

The following water-soluble polyvinyl acetals were used in the following examples:

TABLE 3

| Polymer (structure above) | Designation |
|---|---|
| R = $CH_3$, x = 10, y = 90 | P-1 |
| R = $CH_3$, x = 20, y = 80 | P-2 |

Preparation of Polyvinyl acetal:

100 g of Vinol 107 is added to 900 ml of water and heated to 90° C. for one hour to give a clear solution. The solution is cooled to 10° C. , 57 ml of 36% hydrochloric acid is added and the mixture is cooled to 10° C. 8 g of acetaldehyde is then added with good stirring. The mixture is stirred at 10° C. for 30 min. and then at 35° C. for 4 hours. The pH of the solution is adjusted to 7 with 10% sodium hydroxide and the solution is dialized for 16 hours. The resulting clear solution contains 7.8% solids. The polyvinylacetal polymer contains 10 mol % acetal and 90 Mol % alcohol by NMR analysis.

For each of the overcoat variations the adhesion of the overcoat layer to the imaging layer was evaluated using a practical tape adhesion test and a 90° peel test.

Practical tape test: a 35 mm wide sample was prepared and laid flat on a table. A section of Scotch Magic Tape #811, available from 3M, was placed across the width of the sample and smoothed out by hand to assure uniform adhesion. Upon manually removing the tape, the percent of the overcoat layer removed was estimated and related to adhesion. Ideally, the extent of removal would be zero. The test performed up to ten times for each sample.

90° peel test: Using a 35 mm wide by 10 cm long coated sample, a piece of Scotch Magic Tape #610, available from 3M, was placed along the length of the sample. The tape was then trimmed to approximately 1.27 cm wide and then the sample was mounted onto a flat surface. Upon peeling the tape at 90° to the surface the overcoat was removed with the tape and the force to remove the tap/overcoat at a rate of 5 cm/min. was measured using an Instron Model 1122. This force was then normalized with the tape width and is reported in units of N/m. The larger the value, the stronger the adhesion of the overcoat to the imaging layer. A designation of "Does not peel" indicates that the overcoat could not be removed.

The effect of the poly(vinyl acetal) additive on sensitometry was determined by measuring the $D_{mim}$, relative speed and Dmax of each sample after exposure ($10^{-3}$ sec., EG&G, Wratten 29 filter) and heat processing for 5 seconds at 119 ° C. For all the samples the sensitometry was equivalent to the comparison coating, with just PSA/PVA in the overcoat.

The following table lists the polyvinyl acetal containing overcoats with the adhesion results.

TABLE 5

| Example | Water-soluble PV Acetal | PVA/PV Acetal | Tape Adhesion (% removed) | 90° Peel Force (N/m) | % PV Acetal in the dried Overcoat |
|---|---|---|---|---|---|
| comparison | none | 100/0 | 84 | 4.6 | 0 |
| invention | P-1 | 9/1 | 80 | not tested | 4 |
| invention | P-1 | 4/1 | 25 | not tested | 8 |
| invention | P-1 | 1/1 | 28 | 5.2 | 20 |
| invention | P-2 | 9/1 | 33 | not tested | 4 |
| invention | P-2 | 4/1 | 12 | not tested | 8 |
| invention | P-2 | 1/1 | 0 | 7.9 | 20 |

The preferred concentration range for the polyvinyl acetal additive is between 5 and 25 wt % of the dried overcoat with 20% being the most preferred.

EXAMPLE 2

Example 1 was repeated except polyvinyl acetal is replaced with comparative water-soluble polymers (C-1, C-2, C-3, C-4). When added to the overcoat solution, these comparative polymers cause precipitation of the mixture which could not be coated. This demonstrates that not all mixtures of water-soluble polymers provide the same advantage as the use of the polyvinyl acetal.

C1 is polyvinyl pyrrolidinone,

C2 is poly(2-aminoethyl methacrylate hydrochloride),

C3 is poly(2-aminoethyl methacrylate hydrochloride-co-2-hydroxyetheyl methacrylate), 90/10 mole ratio, and C4 is poly(propyleneglycol monomethacrylate).

The present invention provides an important improvement in thermally processable imaging elements. A hydrophilic overcoat layer, such as a layer containing poly(silicic acid) and poly(vinyl alcohol), provides excellent protection for such elements. However, the degree of adhesion of such an overcoat layer to hydrophobic imaging layers, such as those that contain poly(vinyl butyral), is inadequate as a consequence of the general lack of compatibility of hydrophilic and hydrophobic layers. The addition of the mixture of a water-soluble, hydroxyl-containing monomer or polymer and a polyvinyl acetal overcomes the problem of inadequate adhesion and does so with low cost readily-available materials which are easy to coat and handle, are environmentally advantageous and do not cause adverse sensitometric effects.

The invention has been described in detail, with particular reference to certain preferred embodiments thereof, but it should be understood that variations and modifications can be effected within the spirit and scope of the invention.

We claim:

1. A thermally processable imaging element, said element comprising a support, a thermographic or photothermographic imaging layer, and an overcoat layer comprising:

(A) 50 to 90% by weight of poly(silicic acid) represented by formula (I):

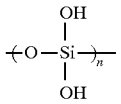

(I)

wherein n is an integer within the range of at least 3 to about 600; and (B) 10 to 50% by weight of a mixture of:

(i) a water-soluble hydroxyl-containing polymer; and (ii) a water-soluble polyvinyl acetal represented by formula (II):

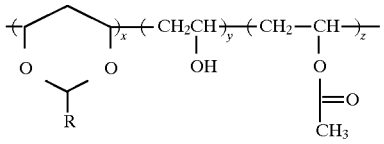

(II)

wherein

R is hydrogen or a substituted or unsubstituted alkyl group of 1 to 8 carbon atoms, or a substituted or unsubstituted cycloalkyl group of 5 to 8 carbon atoms, or a substituted or unsubstituted aryl group;

x represents 2 to 30 mole percent;

y represents 50 to 98 mole percent; and z represents 0 to 10 mole percent.

2. A thermally processable imaging element as claimed in claim 1, wherein the water-soluble hydroxyl-containing polymer is polyvinyl alcohol.

3. A thermally processable imaging element as claimed in claim 1 or claim 2, wherein in formula (II) R is $CH_3$, x is 10 and y is 90.

4. A thermally processable imaging element as claimed in claim i or claim 2, wherein in formula (II) R is $CH_3$, x is 20 and y is 80.

5. A thermally processable imaging element as claimed in claim 1 wherein said support is a poly(ethylene terephthalate) film.

6. A thermally processable imaging element as claimed in claim 1, additionally comprising a backing layer on the side of said support opposite to said imaging layer.

7. A thermally processable imaging element as claimed in claim 6, wherein said backing layer is comprised of a binder and a matting agent dispersed therein.

8. A thermally processable imaging element as claimed in claim 1 wherein said imaging layer comprises:

(a) photographic silver halide, (b) an image-forming combination comprising (i) an organic silver salt oxidizing agent, with (ii) a reducing agent for the organic silver salt oxidizing agent, and (c) a toning agent.

9. A thermally processable imaging element as claimed in claim 1 wherein said imaging layer comprises a poly(vinyl butyral) binder.

10. A thermally processable imaging element, said element comprising a poly(ethylene terephthalate) film support having a backing layer comprised of poly(silicic acid) and poly(vinyl alcohol), on one side thereof and having on the opposite side, in order, a photothermographic imaging layer comprising silver halide, silver behenate and poly(vinyl butyral), and an overcoat layer comprised of poly(silicic acid) and a mixture of poly(vinyl alcohol)and a polyvinyl acetal of formula II:

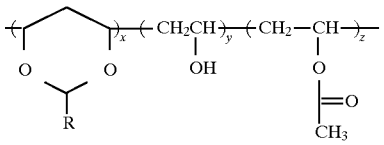

(II)

wherein

R is hydrogen or a substituted or unsubstituted alkyl group of 1 to 8 carbon atoms, or a substituted or unsubstituted cycloalkyl group of 5 to 8 carbon atoms, or a substituted or unsubstituted aryl group;

x represents 2 to 30 mole percent;

y represents 50 to 98 mole percent; and z represents 0 to 10 mole percent.

* * * * *

UNITED STATES PATENT AND TRADEMARK OFFICE

CERTIFICATE OF CORRECTION

PATENT NO. : 5,891,610
DATED : April 6, 1999
INVENTOR(S) : Charles L. Bauer, et al It is certified that error appears in the above-identified patent and that said Letters Patent is hereby corrected as shown below:

| | |
|---|---|
| Claim No. 4, Column No. 11 | -- A thermally processable imaging element as claimed in claim "i" -1- or claim 2, wherein in formula (II) R is . . . -- |

Signed and Sealed this

Twenty-eighth Day of March, 2000

*Attest:*

Q. TODD DICKINSON

*Attesting Officer*

*Commissioner of Patents and Trademarks*